US009511584B2

(12) United States Patent
Clark et al.

(10) Patent No.: US 9,511,584 B2
(45) Date of Patent: Dec. 6, 2016

(54) PRINT HEAD DIE WITH THERMAL CONTROL

(71) Applicant: Hewlett-Packard Development Company, L.P., Houston, TX (US)

(72) Inventors: Garrett E. Clark, Corvallis, OR (US); Chris Bakker, Corvallis, OR (US); Mark H. MacKenzie, Corvallis, OR (US); Glenn D. McCloy, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/418,442

(22) PCT Filed: Sep. 25, 2012

(86) PCT No.: PCT/US2012/057031
§ 371 (c)(1),
(2) Date: Jan. 30, 2015

(87) PCT Pub. No.: WO2014/051540
PCT Pub. Date: Apr. 3, 2014

(65) Prior Publication Data
US 2015/0239237 A1 Aug. 27, 2015

(51) Int. Cl.
*B41J 2/17* (2006.01)
*B41J 2/045* (2006.01)
(Continued)

(52) U.S. Cl.
CPC ..... *B41J 2/0454* (2013.01); *B41J 2/0458* (2013.01); *B41J 2/04563* (2013.01);
(Continued)

(58) Field of Classification Search
CPC ..... B41J 29/393; B41J 29/38; B41J 29/02; B41J 11/42; B41J 2/1422; B41J 2/14; B41J 2002/14419; B41J 2202/20; B41J 2/175; B41J 2/07; B41J 2/1433; B41J 2/135
See application file for complete search history.

(56) References Cited

U.S. PATENT DOCUMENTS 5,016,023 A 5/1991 Chan
7,350,902 B2 * 4/2008 Dietl ..... B41J 2/1404 347/40

(Continued)

FOREIGN PATENT DOCUMENTS

CN 1883944 12/2006
KR 20100092223 8/2010
WO WO-2012044299 4/2012

OTHER PUBLICATIONS

International Search Report for PCT/US2012/057031 dated Jan. 31, 2013.

*Primary Examiner* — Lamson Nguyen
(74) *Attorney, Agent, or Firm* — HP Inc—Patent Department

(57) ABSTRACT

A print head die with thermal control is described. In an example, a print head die includes a substrate having liquid feed slots formed therein extending along a major dimension of the substrate and nozzles extending along opposite sides of each of the liquid feed slots; a temperature sensor formed on the substrate adjacent to a first one of the liquid feed slots; and electrical interconnect formed on the substrate along the major dimension adjacent to a last one of the liquid feed slots farthest from the first liquid feed slot.

13 Claims, 6 Drawing Sheets

(51) Int. Cl.
*B41J 2/14* (2006.01)
*B41J 2/155* (2006.01)

(52) U.S. Cl.
CPC ..... *B41J 2/04581* (2013.01); *B41J 2/04586* (2013.01); *B41J 2/14072* (2013.01); *B41J 2/155* (2013.01); *B41J 2002/14491* (2013.01)

(56) References Cited

U.S. PATENT DOCUMENTS

| | | | |
|---|---|---|---|
| 2003/0122898 | A1 | 7/2003 | Beerling et al. |
| 2006/0066681 | A1 | 3/2006 | King et al. |
| 2010/0201734 | A1 | 8/2010 | Kuk |

* cited by examiner

PRINT HEAD DIE WITH THERMAL CONTROL

CROSS-REFERENCE TO RELATED APPLICATION

The present application claims priority under 35 USC 119 from PCT patent application PCT/US2012/057031 filed on Sep. 25, 2012 by Clark et al. and entitled PRINT HEAD DIE WITH THERMAL CONTROL, the full disclosure of which is hereby incorporated by reference.

BACKGROUND

In some inkjet printers, a stationary media wide printhead assembly, commonly called a print bar, is used to print on paper or other print media moved past the print bar. The print bar can include a page-wide array of print heads to print across the width of a medium in fewer passes or even a single pass.

BRIEF DESCRIPTION OF THE DRAWINGS

Some embodiments of the invention are described with respect to the following figures.

DETAILED DESCRIPTION

Figure 1:
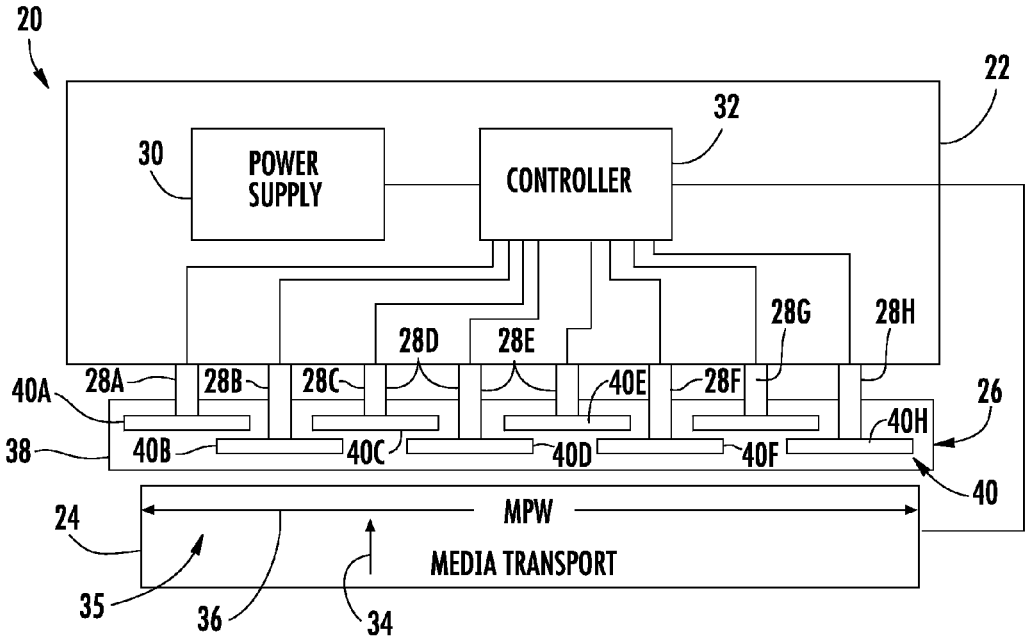
FIG. 1 is a schematic illustration of an example printing system including a page wide array of staggered and overlapping print head dies.

FIG. 1 illustrates an example printing system 20 with portions schematically shown. As will be described hereafter, printing system 20 communicates with multiple staggered and overlapping print head dies such that the print head dies may be more closely spaced to reduce print quality defects. Printing system 20 comprises a main control system 22, media transport 24, page wide array 26 and the electrical interconnects 28A, 28B, 28C, 28D, 28E, 28F, 28G and 28H (collectively referred to as interconnects 28).

Main control system 22 comprises an arrangement of components to supply electrical power and electrical control signals to page wide array 26. Main control system 22 comprises power supply 30 and controller 32. Power supply 30 comprises a supply of high voltage. Controller 32 comprises one or more processing units and/or one or more electronic circuits configured to control and distribute energy and electrical control signals to page wide array 26. Energy distributed by controller 32 may be used to energize firing resisters to vaporize and eject drops of printing liquid, such as ink. Electrical signals distributed by controller 32 control the timing of the firing of such drops of liquid. Controller 32 further generates control signals controlling media transport 28 to position media opposite to page wide array 26. By controlling the positioning a media opposite to page wide array 26 and by controlling the timing at which drops of liquid are eject or fired, controller 32 generates patterns or images upon the print media.

Media transport 24 comprises a mechanism configured to position a print medium with respect to page wide array 26. In one implementation, media transport 24 may comprise a series of rollers to drive a sheet of media or a web of media opposite to page wide array 26. In another implementation, media transport 24 may comprise a drum about which a sheet or a web of print media is supported while being carried opposite to page wide array 26. As shown by FIG. 1, media transport 28 moves print medium in a direction 34 along a media path 35 having a width 36. The width 36 is generally the largest dimension of print media that may be moved along the media path 35.

Page wide array 26 comprises support 38, printing liquid supplies 39 and print head dies 40A, 40B, 40C, 40D, 40E, 40F, 40G and 40H (collectively referred to as print head dies 40). Support 38 comprises one or more structures that retain, position and support print head dies 40 in a staggered, overlapping fashion across width 36 of media path 35. In the example implementation, support 38 staggers and overlaps printer dies 40 such that an entire desired printing width or span of the media being moved by media transport 34 may be printed in a single pass or in fewer passes of the media with respect to page wide array 26.

Figure 2:
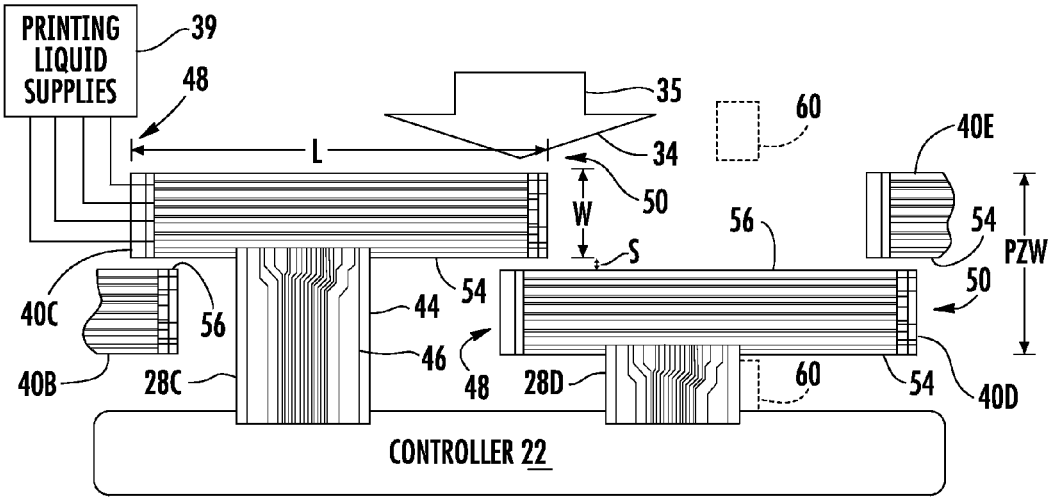
FIG. 2 is an enlarged view of a portion of FIG. 1 illustrating the example printing system.

Printing liquid supplies 39, one of which is schematically shown in FIG. 2, comprise reservoirs of printing liquid. Supplies are fluidly connected to each of dies 40 so as to supply printing liquid to dies 40. In one implementation, printing liquid supplies 39 supply multiple colors of ink to each of print head dies 40. For example, in one implementation, printing liquid supply 39 supplies cyan, magenta, yellow and black inks to each of dies 40. In one implementation, printing liquid supplies 39 are supported by support 38. In another implementation, printing liquid supplies 39 comprise off-axis supplies.

Print head dies 40 comprise individual structures by which nozzles and liquid firing actuators are provided for ejecting drops of printing liquid, such as ink. FIG. 2 illustrates print head dies 40C and 40D, and their associated electrical interconnects 28C and 28D, respectively, in more detail. As shown by FIG. 2, each of print head dies 40 has a major dimension, length L, and a minor dimension, width W. The length L of each print head die 40 extends perpendicular to direction 34 of the media path 35 while partially overlapping the length L of adjacent print head dies 40. The width W of each print head die 40 extends in a direction parallel to direction 34 of the media path 35.

Interconnects 28 comprise structures 44 supporting or carrying electrically conductive lines or traces 46 to transmit electrical energy (electrical power for firing resisters and electrical signals or controlled voltages to actuate the supply of the electrical power to the firing resisters) from controller 22 to the firing actuators of the associated print head die 40. Interconnects 28 are electrically connected to each of their associated print head dies 40 along the major dimension, length L, of the associated die 40. Interconnects 28 are spaced from opposite ends 48 and 50 of the associated print head die 40. Interconnects 28 do not extend between sides 54 and 56 of consecutive print head dies 40. Because interconnects 28 are spaced from opposite ends 48, 50 and do not extend between sides 54 and 56 of consecutive print head dies 40, interconnects 28 do not obstruct or interfere with overlapping of consecutive print head dies 40. As a result, dies 40 may be more closely spaced to one another in direction 34 (the media axis or media advanced direction) to reduce the spacing S between sides 54 and 56 of consecutive dies 40.

Because printing system 20 reduces the spacing S between sides 54, 56 of consecutive print head dies 40, printing system 20 has a reduced print zone width PZW which enhances dot placement accuracy and performance. In implementations in which different colors of ink are deposited by each of the print head dies 40, reducing the print zone width PZW allows different dies 40 to deposit droplets of colors on the print media closer in time for enhanced and more accurate color mixing and/or half-toning. In implementations in which media transport 24 drives or guides the print media opposite to dies 40 using one or more rollers 60 on opposite sides of the print zone, reducing the print zone with PZW allows such rollers 60 (shown in broken lines in FIG. 2) to be more closely spaced to each another adjacent to the print zone. As a result, skewing or otherwise incorrect positioning of print media opposite to print head dies 40 by rollers 60 is reduced to further enhance print quality.

In the example implementation illustrated, each of interconnects 28 is physically and electrically connected to an associated print head die 40 while being centered between opposite ends of length L. As a result, consecutive print head dies 40 on each side of the interconnects 28 may be equally overlap with respect to the intermediate print head die 40. In other implementations, interconnects 28 may be physically and electrically connected to an associated print head die 40 asymmetrically between ends 48, 50 of the die 40.

Figure 3:
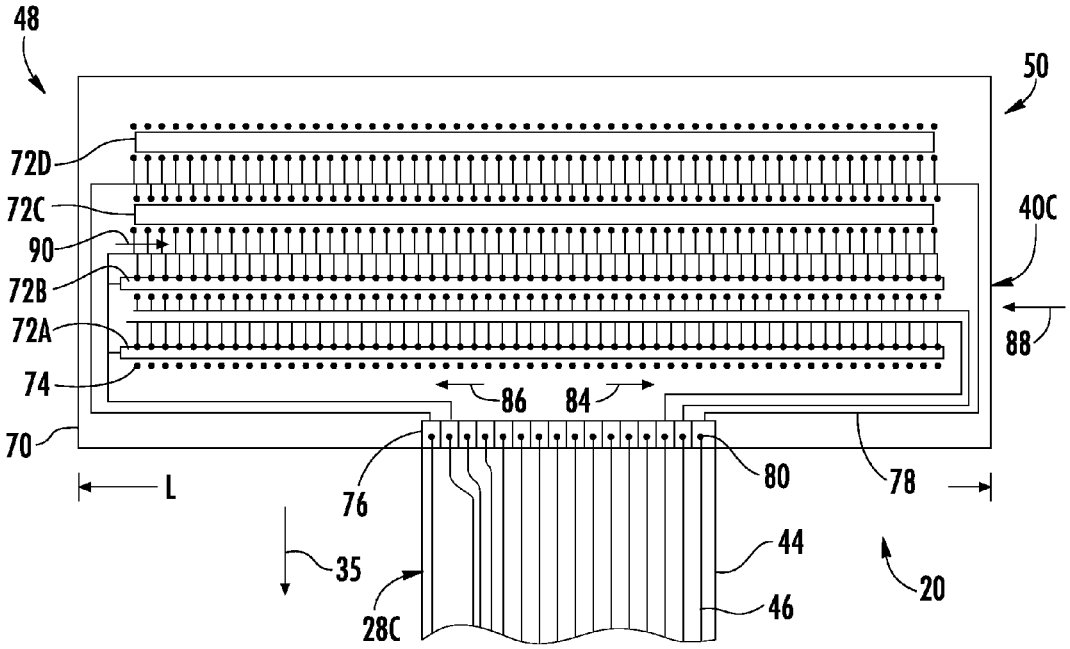
FIG. 3 schematically illustrates one example of print head die and its associated electrical interconnect.

FIG. 3 schematically illustrates one example of print head die 40C and its associated electrical interconnect 28C. Each of the other print head dies 40 and their associated electrical interconnects 28 may be substantially identical to the print head die 40C and electrical interconnect 28C being shown. As shown by FIG. 3, print head die 40C comprises a substrate 70 forming or providing liquid feed slots 72A, 72B, 72C and 72D (collectively referred to as slot 72) to direct printing liquids received from supply 39 (shown in FIG. 2) to each of the nozzles 74 extending along opposite sides of each of slots 72. In one implementation, liquid feed slots 72 supply cyan, magenta, yellow and black ink to the associated nozzle 74 on either side of the slot 72. An example order of cyan, magenta, yellow, and black inks with respect to liquid feed slots 72A through 72D is described below.

Nozzles 74 comprise openings through which drops of printing liquid is ejected onto the print medium. In one implementation, print head die 40 comprises a thermoresistive print head in which firing actuators or resisters substantially opposite each nozzle are supplied with electrical current to heat such resisters to a temperature such that liquid within a firing chamber opposite each nozzle is vaporized to expel remaining printing liquid through the nozzle 74. In another implementation, print head die 40 may comprise a piezoresistive type print head, wherein electric voltage is applied across a piezoresistive material to cause a diaphragm to change shape to expel printing liquid in a firing chamber through the associated nozzle 74. In still other implementations, other liquid ejection or firing mechanisms may be used to selectively eject printing liquid through such nozzle 74.

To facilitate the supply of electrical current to the firing mechanisms associate with each of nozzle 74, print head die 40C further comprises electrical connectors 76 and electrically conductive traces 78. Electrical connectors 76 comprise electrically conductive pads, sockets, or other mechanisms or surfaces by which traces 78 of die 40C may be electrically connected to corresponding electrically conductive traces 46 of electrical interconnect 28C. Electrical connectors 76 extend along the major dimension or length L of print head die 40C facilitate electrical connection of interconnect 44 to the major dimension or length L of print head die 40C. In the example illustrated, electrical connectors 76 comprise electrically conductive contact pads or contact surfaces against which electrical leads 80 of traces 46 are connected. In other implementations, the electrical connector 76 may comprise other structures facilitating electrical connection or electrical attachment of traces 46 of interconnect 28C to traces 78 of die 40C.

Electrically conductive traces 78 (a portion of which are schematically shown in FIG. 3) comprise lines of electrically conductive material formed upon substrate 70. Electrically conductive traces 78 transmit electrical power as well as electrical control signals to the firing mechanisms associate with each of nozzles 74. As shown by FIG. 3, electrically conductive traces 78 extend from electrical connectors 76 in outward directions 84, 86 perpendicular to the media path 35, extend around the ends of slots 72 and extend in inward directions 88, 90 between slots 72. Electrically conductive traces 78 are further connected to the liquid ejection mechanisms or firing actuators for each of nozzles 74. In one implementation, electrically conductive traces 78 extend between slots 72 from one end to the other end of die 40C. In another implementation, electrically conductive traces 78 extend between slots 72 from both ends 48, 50, one trace 78 extending a first portion of the distance from a left end 48 of die 40C and another trace 78 extending a portion of the distance from a right end 50 of die 40C. In yet other implementations, other tracing patterns or layouts may be employed.

One implementation, electrical interconnects 28 each comprise a flexible circuit. In another implementation, electrical interconnects 28 each comprise a rigid circuit board. Although system 20 is illustrated as including eight print head dies 40, in other implementations, system 20 may have other numbers of print head dies 40. For example, in one implementation in which media path 35 is 8.5 inches wide, system 20 comprises 10 staggered and overlapping print head dies 40 that collectively span the 8.5 inches. In other implementations, system 20 may have other configurations and dimensions to accommodate other media path widths.

Figure 4:
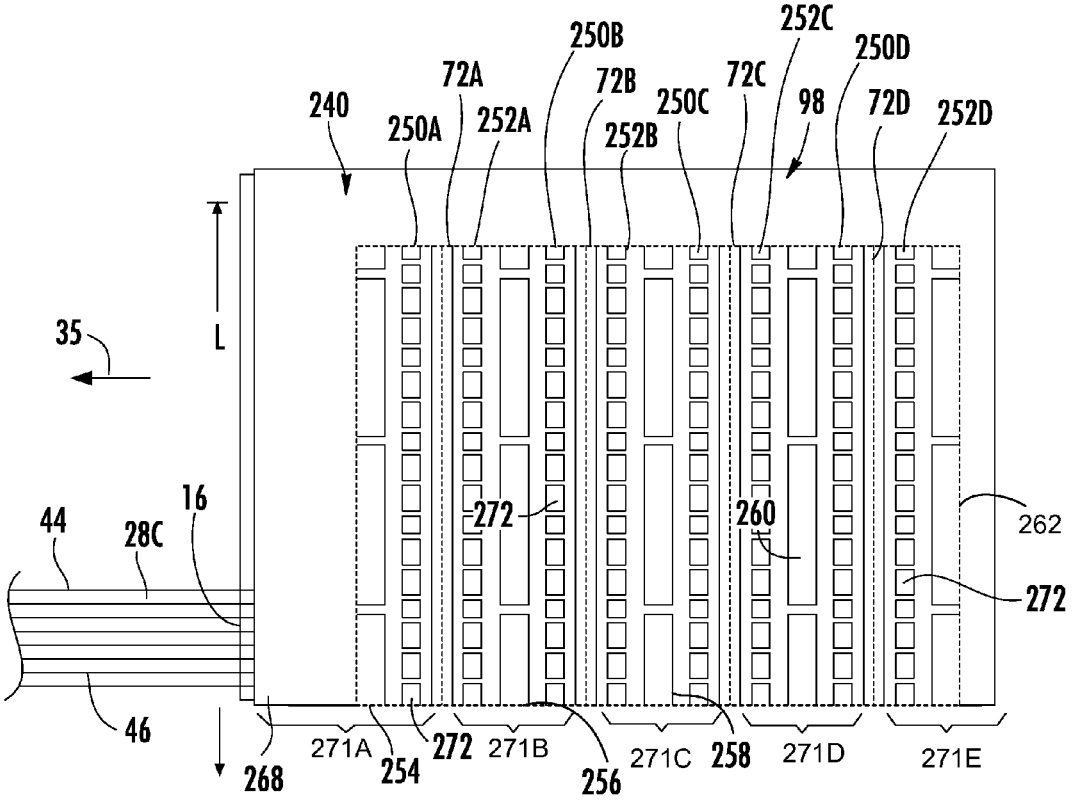
FIG. 4 is a fragmentary schematic illustration of another example print head die and electrical interconnect for the printing system of FIG. 1.

FIG. 4 illustrates an end portion of an example print head die 240 which may be utilized in system 20 for each of print head dies 40. Print head die 240 is similar to print head die 40C (each of the other print head dies 40 of system 20) in that print head die 240 receives electrical power and electrical data signals (printing signals or logic voltages) through interconnect 28C which is connected to connectors 76 along the major dimension, length L, which extends perpendicular to the media advance direction or media path 35.

As shown by FIG. 4, print head die 240 comprises slots 72 (described above with respect to print head die 40C in FIG. 3), nozzle columns 250A, 250B, 250C and 250D (collectively referred to as nozzle columns 250), nozzle columns 252A, 252B and 252C, 252D (collectively referred to as nozzle columns 252), and column circuits 254, 256, 258, 260 and 262. Nozzle column 250A is supported by rib 271A adjacent to a left side of the slot 72A. Nozzle columns 252A and 250B are supported by a rib 271B between slots 72A and 72B. Nozzle columns 252B and 250C are supported by a rib 271C between slots 72B and 72C. Nozzle columns 252C and 250D are supported by a rib 271D between slots 72C and 72D. Nozzle column 252D is supported by a rib 271E to a right side of the slot 72D. Ribs 271A through 271E are collectively referred to as ribs 271.

Each of nozzle columns 250, 252 comprise a plurality of nozzles 74 (shown in FIG. 3) and an associated printing liquid firing actuator or mechanism 272 (schematically shown as boxes). Each printing liquid firing mechanism 272 receives ink or other printing liquid from the adjacent slot 72, whereby the printing liquid or ink is selectively ejected through the associated nozzle 74 using voltages and signals from electrical interconnect (shown in FIG. 3). Column circuits 254-262 generally designate electrical traces for transmitting other data and control signals for each of the liquid firing mechanisms 272 of the adjacent nozzle columns 250, 252. In one implementation, the electrical interconnect (shown in FIG. 3) cooperates to provide an electrical voltage across the resistors of liquid firing mechanisms 272 in response to control signals from controller 32. In one implementation, such control signals comprise electrical signals communicated to transistors of the liquid firing mechanism 272.

In an example implementation and as shown above, each print head die includes four ink feed slots. The four ink slots can deliver yellow, cyan, magenta, and black ink to the nozzles. In an example implementation, the ink slot closest to the electrical interconnect, i.e., the ink slot 72A, supplies yellow ink. The next ink slot adjacent yellow, i.e., the ink slot 72B, supplies cyan ink. The next ink slot adjacent cyan, i.e., the ink slot 72C, supplies magenta ink. The next ink slot farthest from the electrical interconnect, i.e., the ink slot 72D, supplies back ink. As described below, such an ink order allows for lower print head cost, reduces the visibility of print defects associated with the electrical interconnect, and produces maximum saturation with minimum mottle.

As is the case with many ink sets, the black ink can require a larger amount of ink per area to create a fully saturated color. For this reason, the firing chambers assigned to the black ink use a higher drop volume design that the other colors. The higher drop volume firing chamber requires a correspondingly higher amount of firing energy and larger circuitry to handle this higher energy. If this larger circuitry was contained in the same print head rib as the electrical interconnection, that rib would need to be increased in width to provide sufficient space for all circuitry. In an example implementation, the black ink is fired from nozzles that are not located on the same rib as the electrical interconnect, but on the opposite side of the die. The outermost rib does not need to be widened and has a minimum size determined by mechanical die strength.

For example, the rib 271A includes area for the electrical interconnect (e.g., the electrical connectors 76 and the electrically conductive traces 78). The outermost rib (i.e., the rib farthest from the rib 271A), the rib 271E, does not need to be widened to accommodate the electrical interconnect. Thus, in an example, the nozzle columns 250D and 252D can be used to eject black ink supplied by the slot 72D.

The electrical interconnection to the print head die can be made from materials with high electrical conductivity, such as copper and/or gold. Such materials have high thermal conductivity and serve as a pathway for heat to be removed from the print head die. This thermal pathway can cause a local zone of the print head die that is cooler than the surrounding area, which can cause differences in print head operation, particularly affect inks having lower drop weight. In an example, nozzles nearest to the electrical connectors 76 are selected to eject yellow ink. Defects in the yellow ink channel on printed media are less visible than defects in other ink channels. In an example implementation, the nozzle columns 250D and 252D provide black ink. Placing yellow ink in the slot 72A nearest the electrical connectors 76 also places the yellow ink farthest away from the nozzles ejecting the black ink. Since yellow and black inks have the highest contrast, any unintentional ink mixing between yellow and black is more easily visible on the printed media. Thus, it is desirable to maximize the distance between print structures providing yellow and black ink, respectively, on the print head die.

When printing any set of inks, there can be differences in the resulting output based on the order that the inks are jetted onto the media. The inventors have found, in lower cost page-wide systems, printing magenta ink before cyan ink produced the best color saturation and avoided a negative ink interaction referred to as mottle. As shown in FIG. 4, the ink slot 72C is before the ink slot 72B along the media path 35. Thus, in an example, the ink slot 72C can provide magenta ink to the nozzle columns 250C and 252C, and the ink slot 72B can provide cyan ink to the nozzle columns 250B and 252B. Producing highly saturated colors while avoiding mottle is difficult in systems that do not utilize multi-pass printing. This solution is not, however, universal, as different inks will result in different tradeoffs.

In general, a print head die can include a substrate having liquid feed slots formed therein extending along a major dimension of the substrate and nozzles extending along opposite sides of each of the liquid feed slots. Electrical interconnect can be formed on the substrate along the major dimension adjacent to a last one of the liquid feed slots. A first one of the liquid feed slots opposite the last liquid feed slot is farthest away from the electrical interconnect. The first liquid feed slot can be supplied with an ink that is ejected using higher drop volume than other inks. The last liquid feed slot can be supplied with ink having a higher contrast with the ink in the first liquid feed slot than with other inks. In an example implementation, the last ink can be yellow ink, and the first ink can be black ink. In an example implementation, the first ink is most upstream along the media path and the last ink is most downstream along the media path. A second ink slot adjacent the first ink slot can supply magenta ink, and a third ink slot between the last and second ink slots can supply a cyan ink.

Figure 5:
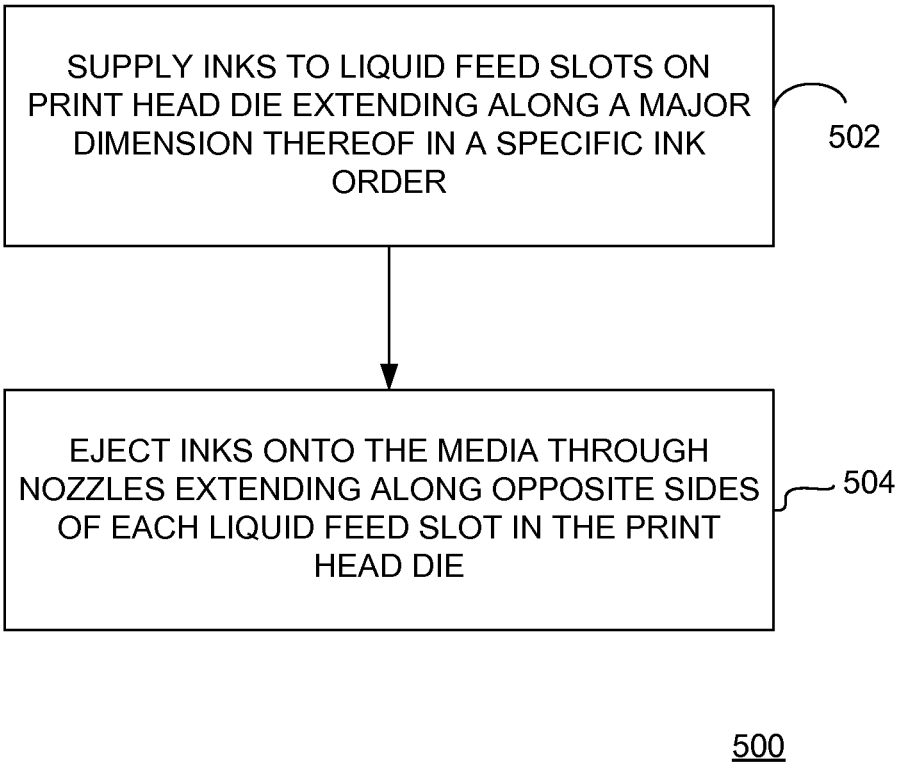
FIG. 5 is a flow diagram depicting a method of ejecting inks onto media moved along a media path with a specific ink order.

FIG. 5 is a flow diagram depicting a method of ejecting inks onto media moved along a media path with a specific ink order. The method 500 begins at step 502, where inks are supplied to liquid feed slots on a print head die extending along a major dimension thereof in a specific ink order. At step 504, the inks are ejected onto the media through nozzles extending along opposite sides of each liquid feed slot on the print head die. In an example implementation, at step 502, a last ink is supplied to a last liquid feed slot on a print head die that is adjacent electrical interconnect formed on the print head die along the major dimension thereof. A first ink is supplied to a first liquid feed slot on the print head die that is farthest from the electrical interconnect. The first ink uses a higher drop volume than inks supplied by other liquid feed slots on the print head die. The last ink has higher contrast with the first ink than with inks supplied by other liquid feed slots on the print head die. In an example, the last ink is yellow ink and the first ink is black ink.

In an example, at step 502, the first liquid feed slot is a most upstream liquid feed slot along the media path and the last liquid feed slot is most downstream along the media path. A magenta ink can be supplied to a second liquid feed slot on the print head die adjacent to the first liquid feed slot. A cyan ink can be supplied to a third liquid feed slot on the print head die between the second and last liquid feed slots.

Figure 6:
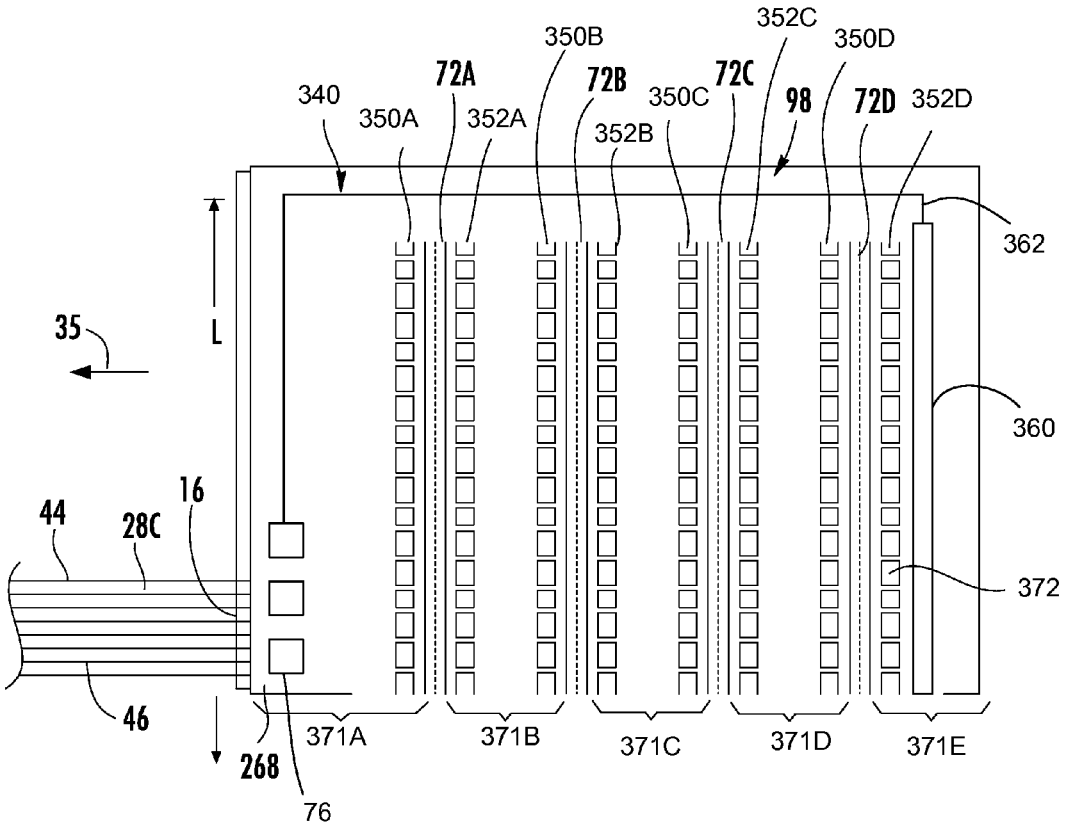
FIG. 6 is a fragmentary schematic illustration of another example print head die and electrical interconnect for the printing system of FIG. 1.

FIG. 6 schematically illustrates a portion of an example print head die 340 which may be utilized in system 20 for each of print head dies 40. Print head die 340 is similar to print head die 40C (each of the other print head dies 40 of system 20) and print head die 240 in that print head die 340 receives electrical power and electrical data signals (printing signals or logic voltages) through interconnect 28C which is connected to connectors 76 along the major dimension, length L, which extends perpendicular to the media advance direction or media path 35.

As shown by FIG. 6, print head die 340 comprises slots 72 (described above with respect to print head die 40C in FIG. 3), nozzle columns 350A, 350B, 350C and 350D (collectively referred to as nozzle columns 350), nozzle columns 352A, 352B and 352C, 352D (collectively referred to as nozzle columns 352), a temperature sensor 360, and electrically conductive trace 362. Nozzle column 350A is supported by rib 371A adjacent to a left side of the slot 72A. Nozzle columns 352A and 350B are supported by a rib 371B between slots 72A and 72B. Nozzle columns 352B and 350C are supported by a rib 371C between slots 72B and 72C. Nozzle columns 352C and 350D are supported by a rib 371D between slots 72C and 72D. Nozzle column 352D is supported by a rib 371E to a right side of the slot 72D. Ribs 371A through 371E are collectively referred to as ribs 371. The electrical connectors 76 are located along the long edge of the print head die 340 on the rib 371A.

Each of nozzle columns 350, 352 comprise a plurality of nozzles 74 (shown in FIG. 3) and an associated printing liquid firing actuator or mechanism 372 (schematically shown as boxes). Each printing liquid firing mechanism 372 receives ink or other printing liquid from the adjacent slot 72, whereby the printing liquid or ink is selectively ejected through the associated nozzle 74 using voltages and signals from electrical interconnect (shown in FIG. 3).

In an example implementation, the temperature sensor 360 is disposed on the rib 371E between the nozzle column 352D and the long edge of the print head die 340. The temperature sensor 360 extends along the major dimension of the print head die 340 for at least the extent of the nozzle column 352D. As shown in FIG. 6, the temperature sensor 360 extends the length of the nozzle column 352D and past the ends of the nozzle column 352D, but stops before the short edges of the print head die 340. In an example implementation, the temperature sensor 360 is a temperature sense resistor (TSR). In another example, the temperature sensor 360 is a thermal diode. In general, the temperature sensor 360 can be any type of thermal sensing device capable of being integrated in and/or mounted to the print head die 340.

In an example, the temperature sensor 360 is located in an area of low electrical circuit density. The electrical connectors 76 are located on the first rib 371A, along with most of the electrically conductive traces (shown in FIG. 3). The electrically conductive trace 362 couples the temperature sensor 360 to the electrical connectors 76 so that temperature measurements can be sent from the print head die 340 to controller 32 (shown in FIG. 1). Since the rib 371E has low electrical circuit density, the rib 371E has space for the temperature sensor 360, which avoids having to widen the rib 371E beyond that necessary for mechanical stability (i.e., no additional silicon area is necessary to accommodate the temperature sensor 360).

In examples described above, the slot 72D supplies black ink. In an example, the temperature sensor 360 is adjacent the slot on the print head die 340 supplying black ink. In a printing system, black ink is typically the most utilized ink color. Thus, if only a single temperature sensor is used as in the present example, it is desirable to monitor temperature adjacent the most utilized nozzles/slot—i.e., the slot and nozzles used to supply and eject black ink.

In an example, the controller 32 configures a thermal energy setting to determine the appropriate firing energy for the firing actuators across the different ink colors. The controller 32 can configure the thermal energy setting during startup of the printer. The controller 32 can obtain temperature information from the temperature sensor 360 that is adjacent the slot 72D, which in an example, supplies black ink. The controller 32 can then determine firing energy for the firing actuators of the nozzle columns 250D and 252D receiving ink from the slot 72D (e.g., firing energy for the black ink). The controller 32 can include offset information for the other ink colors. The offset information is dependent on design aspects of the print head die 340, such as the difference in thermal resistor sizes between the inks, the location of the nozzles/slot for a given color on the die, and the like. The value of the firing energy for the nozzle columns 250D and 252D proximate the temperature sensor 360 can then be used in combination with the offset information to determine the appropriate firing energy settings for the other slots 72A through 72C supplying the other colors (e.g., yellow, cyan, and magenta inks). Since the slots/nozzles for color are built on the same die as the slot/nozzles for black, the slots/nozzles for color are likely to have the similar characteristics as those for black. Thus, the firing energy determined for the ink supplied by the slot 72D (e.g., black in an example) is representative of that necessary for the inks supplied in the other slots adjusted by an offset (since inks supplied to the other slots can have different drop weights).

The configuration of a single temperature sensor as shown in FIG. 6 minimizes the silicon area utilized for temperature measurement and thus reduces print head die cost. Further, in an example, locating the temperature sensor near the most utilized ink color minimizes unsensed thermal excursions. Further, locating the temperature sensor on the outermost rib with respect to the electrical interconnect allows the sensor to be utilized without any additional silicon area. Finally, encoding energy setting information in the controller 32 for the print head die allows the use of the single temperature sensor to determine operating energy for all inks (e.g., offset information can be used to determine firing energy for color inks based on firing energy for black ink).

Figure 7:
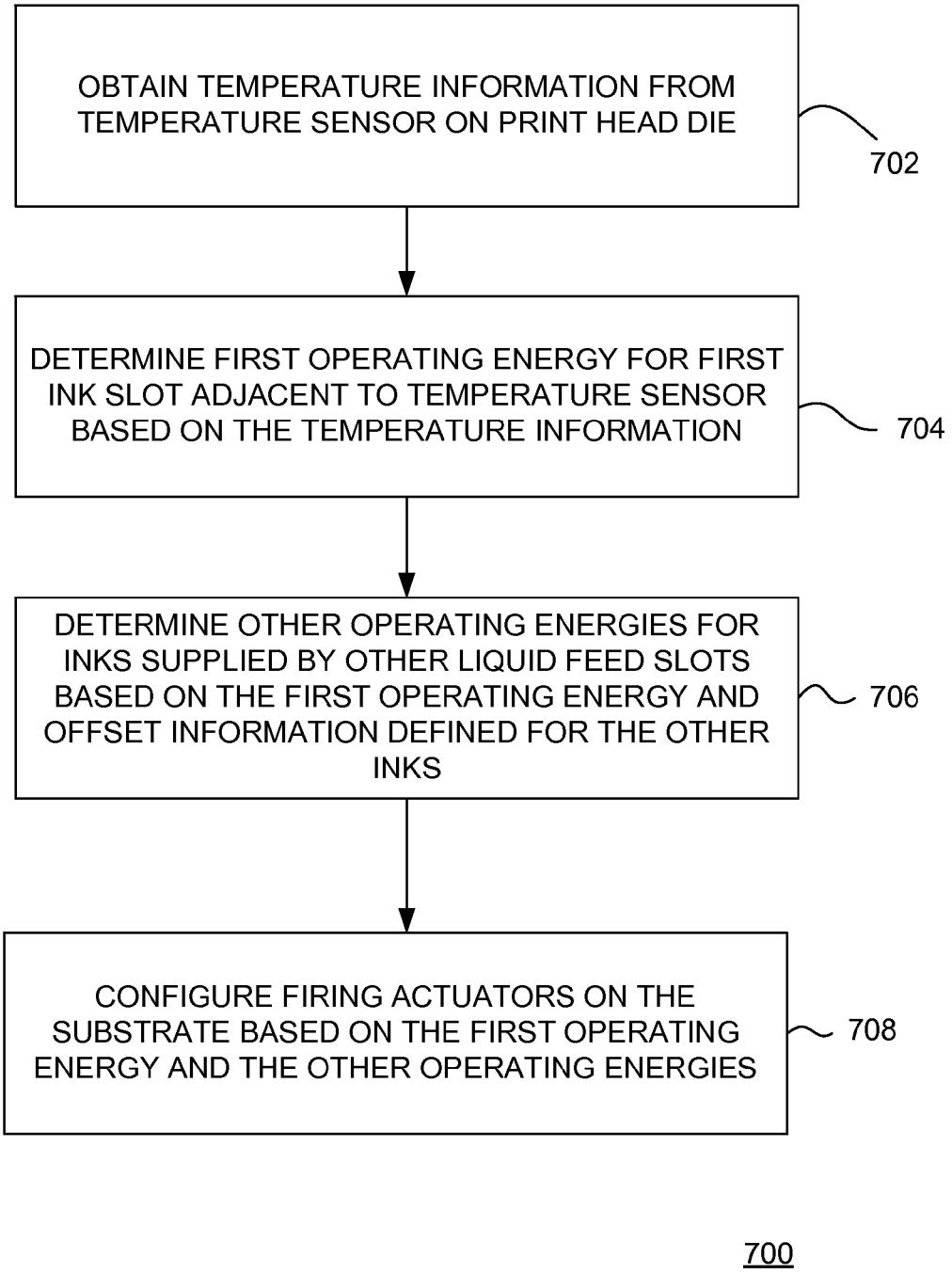
FIG. 7 is a flow diagram depicting a method of thermal control for a print head die according to an example implementation.

FIG. 7 is a flow diagram depicting a method 700 of thermal control for a print head die according to an example implementation. The method 700 begins at step 702, where temperature information is obtained from a temperature sensor formed on the substrate adjacent to a first liquid feed slot farthest from a last liquid feed slot, the last liquid feed slot being adjacent to electrical interconnect formed on the substrate. At step 704, a first operating energy is determined for a first ink supplied by the first liquid feed slot based on the temperature information. At step 706, other operating energies for inks supplied by others of the liquid feed slots based on the first operating energy and offset information defined for the inks. At step 708, configuring firing actuators on the substrate based on the first operating energy and the other operating energies. In an example, the first liquid feed slot supplies black ink. In an example, the last liquid feed slot, a second liquid feed slot, and a third liquid feed slot supply yellow, cyan, and magenta inks.

Various colorants can be used in the inks described herein, including pigments, dyes, or combinations thereof. In a non-limiting example, regarding the cyan ink, the cyan pigment can be a copper phthalocyanine-based pigment including derivatives of C.I. Pigment Blue 15:3 (e.g. Cyan Pigment such as DIC-C026 from DIC, E114645 from Dupont, RXD Cyan from Fujifilm Imaging Colorants (FFIC)). With the magenta ink, the magenta colorant can include a magenta pigment and a slightly soluble magenta dye. In one aspect, the magenta pigment can be a quinacridone-based pigment including derivatives of C.I. Pigment Red 282 (e.g. Magenta Pigment DIC-045 or DIC-034 from DIC, E714645 from Dupont, or Magenta from FFIC). In another aspect, the slightly soluble magenta dye can be Pro-jet™ Fast 2 Magenta Dye from FFIC. Regarding the yellow ink, the yellow pigment can be a butanamide-based pigment including derivatives of C.I. Pigment Yellow 74 (e.g. Yellow Pigment DIC HPC-5002 from DIC or Yellow Pigment 251 from FFIC). In a non-limiting example, black ink can include a black pigment chosen from water dispersible sulfur pigments such as solubilized Sulfur Black 1, materials such as carbon black, non-limiting examples of which include FW18, FW2, FW200 (all manufactured by Degussa Inc. (Dusseldorf, Germany)); MONARCH® 700, MONARCH® 800, MONARCH® 1000, MONARCH® 880, MONARCH® 1300, MONARCH® 1400, REGAL® 400R, REGAL® 330R, REGAL® 660R (all manufactured by Cabot Corporation (Boston, Mass.)); RAVEN® 5750, RAVEN® 250, RAVEN® 5000, RAVEN® 3500, RAVEN® 1255, RAVEN® 700 (all manufactured by Columbian Chemicals, Co. (Marietta, Ga.)), or derivatives of carbon black, and/or combinations thereof.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. An apparatus to print on media moved along a media path, comprising:

a substrate having liquid feed slots formed therein extending along a major dimension of the substrate and nozzles extending along opposite sides of each of the liquid feed slots, the nozzles formed into nozzle columns supported by ribs adjacent to front and back sides of each of the liquid feed slots with respect to the media path;

a temperature sensor formed on the substrate adjacent to a first one of the liquid feed slots, the temperature sensor formed on one of the ribs adjacent to an upstream side of a first liquid feed slot; and electrical interconnect formed on the substrate along the major dimension adjacent to a last one of the liquid feed slots farthest from the fast liquid feed slot, the electrical interconnect formed on one of the ribs adjacent to a downstream side of a last liquid feed slot.

2. The apparatus of claim 1, wherein the first liquid feed slot supplies an ink using a higher drop volume than inks in other ones of the liquid feed slots.

3. The apparatus of claim 2, wherein the first liquid feed slot supplies black ink.

4. The apparatus of claim 2, wherein the last liquid feed slot, a second liquid feed slot, and a third liquid feed slot supply yellow ink, cyan ink, and magenta ink.

5. An apparatus to print on media moved along a media path, comprising:

a support having a first row of independent print head dies spanning across the media path, and a second row of independent print head dies spanning across the media path staggered with respect to the first row along the media path;

the print head dies in the first and second rows each including:

a substrate having liquid feed slots formed therein extending along a major dimension of the substrate and nozzles extending along opposite sides of each of the liquid feed slots;

a temperature sensor formed on the substrate adjacent to a first one of the liquid feed slots; and electrical interconnect formed on the substrate along the major dimension adjacent to a last one of the liquid feed slots farthest from the first liquid feed slot; and a controller electrically coupled to the print head dies in the first and second rows, the controller receiving temperature information from the temperature sensor on each of the print head dies in the first and second rows.

6. The apparatus of claim 5, wherein the first liquid feed slot supplies black ink.

7. The apparatus of claim 6, wherein the last liquid feed slot, a second liquid feed slot, and a third liquid feed slot supply yellow ink, cyan ink, and magenta ink.

8. The apparatus of claim 5, wherein the controller determines an operating energy for the ink in the first liquid feed slot using the temperature information, and determines operating energies for inks in the other liquid feed slots using the operating energy for the ink in the first liquid feed slot and offset information for the inks in the other liquid feed slots.

9. The apparatus of claim 5, wherein the nozzles are formed into nozzle columns supported by ribs adjacent to front and back sides of each of the liquid feed slots with respect to the media path; wherein the electrical interconnect is formed on one of the ribs adjacent to the downstream side of the last liquid feed slot; wherein the temperature sensor is formed on one of the ribs adjacent to the upstream side of the first liquid feed slot.

10. A method of thermal control for a print head die, comprising:

obtaining temperature information from a temperature sensor formed on a substrate adjacent to a first one of a plurality of liquid feed slots, the first liquid feed slot being farthest from a last on of the liquid feed slots, the last liquid feed slot being adjacent to electrical interconnect formed on the substrate along the major dimension;

determining a first operating energy for a first ink supplied by the first liquid feed slot based on the temperature information;

determining other operating energies for inks supplied by others of the liquid feed slots based on the first operating energy and offset information defined for the inks; and configuring firing actuators on the substrate based on the first operating energy and the other operating energies.

11. The method of claim 10, wherein the first liquid feed slot supplies black ink.

12. The method of claim 10, wherein the last liquid feed slot, a second liquid, feed slot, and a third liquid feed slot supply yellow ink, cyan ink, and magenta ink.

13. The method of claim 10, wherein the nozzles are formed into nozzle columns supported by ribs adjacent to front and back sides of each of the liquid feed slots with respect to the media path; wherein the electrical, interconnect is formed on one of the ribs adjacent to the downstream side of the last liquid feed slot; wherein the temperature sensor is formed on one of the ribs adjacent to the upstream side of the first liquid feed slot.

* * * * *